United States Patent [19]

Politzer

[11] Patent Number: 4,780,682

[45] Date of Patent: Oct. 25, 1988

[54] FUNNEL FOR ION ACCELERATORS

[75] Inventor: Peter A. Politzer, Encinitas, Calif.

[73] Assignee: GA Technologies Inc., San Diego, Calif.

[21] Appl. No.: 111,017

[22] Filed: Oct. 20, 1987

[51] Int. Cl.[4] ..... H05H 7/06; H05H 9/00

[52] U.S. Cl. ..... 328/233; 315/5.41

[58] Field of Search ..... 328/233, 235; 315/5.41

[56] References Cited

U.S. PATENT DOCUMENTS 3,331,961 7/1967 Leboutet et al. ..... 328/233 X 3,571,642 3/1971 Westcott ..... 328/233

*Primary Examiner*—Palmer C. DeMeo

*Attorney, Agent, or Firm*—Workman, Nydegger & Jensen

[57] ABSTRACT

A funnel for an ion accelerator comprises a magnetic lens in operative association with a resonator. Ions from different sources are accelerated to different predetermined energy levels and are separately aimed at the lens where the incoming ions are deflected into alignment along a common path. The resonator receives ions from the lens and respectively accelerates or decelerates ions having relatively lower or higher energy levels to establish a beam of ions having substantially the same energy level.

17 Claims, 2 Drawing Sheets

FUNNEL FOR ION ACCELERATORS

BACKGROUND OF THE INVENTION

This invention pertains to devices which provide input to linear accelerators. More particularly, the present invention pertains to a funnel for aligning ions from different sources having different energy levels into a beam of ions which all have substantially the same energy level. The present invention is particularly, but not exclusively, useful in the energy field for generating a high current ion beam.

DESCRIPTION OF THE PRIOR ART

The use of linear accelerators to establish high current levels in ion beams is well known in the pertinent art. Any device or procedure which can be used with a linear accelerator to increase these current levels even further is desirable because increased current means an increased ability to generate and transmit power. As should be expected, several variables are involved in the process of creating higher current levels for ion beams. Perhaps the most important variable in this process is the number of ions which can be aligned in the ion beam. It is known that the output current of a linear accelerator is proportional to the number of ions being accelerated. Thus, providing more ions as input to a linear accelerator is at least a partial solution. Just how this can be done is the problem.

Present technology suffers with an inability to effectively combine a sufficient number of ions as input for a linear accelerator. The immediate difficulty, however, is not with the linear accelerator itself. Instead, the difficulty centers on the ion input to the linear accelerator. Specifically, the problem goes to the ion source itself and the fact that linear accelerators are not operatively compatible with the energy levels generated at the ion source. For example, the output of a typical ion source is approximately 50 KeV. An effective ion input to a linear accelerator, however, should be approximately 2 MeV. This presents an inherent incompatibility. The accepted solution is to interpose a low frequency accelerator between the ion source and the linear accelerator which will take ions from the source at 50 KeV and accelerate them to the 2 MeV level. When elevated to the 2 MeV level, these ions can be used as input for the linear accelerator.

Merely providing properly energized ions as input to the linear accelerator does not, without more, realize the full potential of such a system. It happens that a linear accelerator can handle more input than can be practically put out by a single low frequency accelerator. Thus, a solution for greater efficiency resides in an ability to combine ions from different sources after they have been energized to the 2 MeV level. This, however, is further complicated in that an effective input to a linear accelerator requires all ions be colinearly aligned and have substantially the same energy level. To solve this problem, a device for colinearly aligning ions which come from different low energy accelerators into a beam of ions having substantially the same energy level is disclosed herein for the present invention.

The present invention recognizes that a magnetic lens can be used to colinearly align ions having different energy levels. Further, the present invention recognizes that a resonator can be subsequently used to substantially equalize the energy levels of the colinearly aligned ions. Thus, in accordance with the teachings of the present invention, a high density ion beam which is compatible as input for a linear accelerator can be provided.

It is to be understood that, although the discussion here mentions ions as the particles being colinearly aligned by the funnel of the present invention, the funnel of the present invention is efficacious for colinearly aligning either ions or electrons. Further, these particles can be either positively or negatively charged.

Accordingly, it is an object of the present invention to provide a funnel for a linear accelerator which will colinearly align ions or electrons from different sources. Another object of the present invention is to provide a funnel which will substantially equalize the energy levels of ions or electrons in a beam. Still another object of the present invention is to provide means which allows use of numerous cascaded sources to increase the ion or electron density of a beam. Yet another object of the present invention is to provide a funnel for charged particle accelerators which is relatively easy to use and which is cost effective.

SUMMARY OF THE INVENTION

In accordance with the present invention, the preferred embodiment of a funnel for ion accelerators comprises a magnetic lens which is positioned for operative association with a resonator. A pair of ion sources each directs ions through a respective low frequency accelerator to establish separate ion rays having different energy levels. These rays are separately aimed at the magnetic lens where their constituent ions are deflected into alignment with the ions of the other ray. This forms a sequence of colinearly bunched ions wherein all odd-numbered bunches have a common energy level which is different from the common energy level of the even-numbered bunches. The aligned bunches of ions are then directed toward the resonator where those ions having the relatively lower energy level are accelerated and those ions having the relatively higher energy level are decelerated. The result of this action is a beam of ions having substantially the same energy level. This beam can then be directed to yet another funnel for combination with still more ions, or directed to a linear accelerator for acceleration to increase the beam's current level. The preferred embodiment also comprises means for synchronizing the resonator of the funnel with emissions from the respective ion sources in order to ensure that lower energy ions are accelerated and higher energy ions are decelerated.

As suggested above and envisioned for the present invention, several ion sources may be cascaded. For example, ions from a pair of sources can be combined into a beam by one funnel and thereafter used as one of a pair input to yet another funnel. Numerous ion sources can be combined in this manner.

The novel features of this invention as well as the invention itself, both as to its organization and operation, will be best understood from the accompanying description in which similar reference characters refer to similar parts and in which:

DESCRIPTION OF THE PREFERRED EMMBODIMENT

Figure 1:
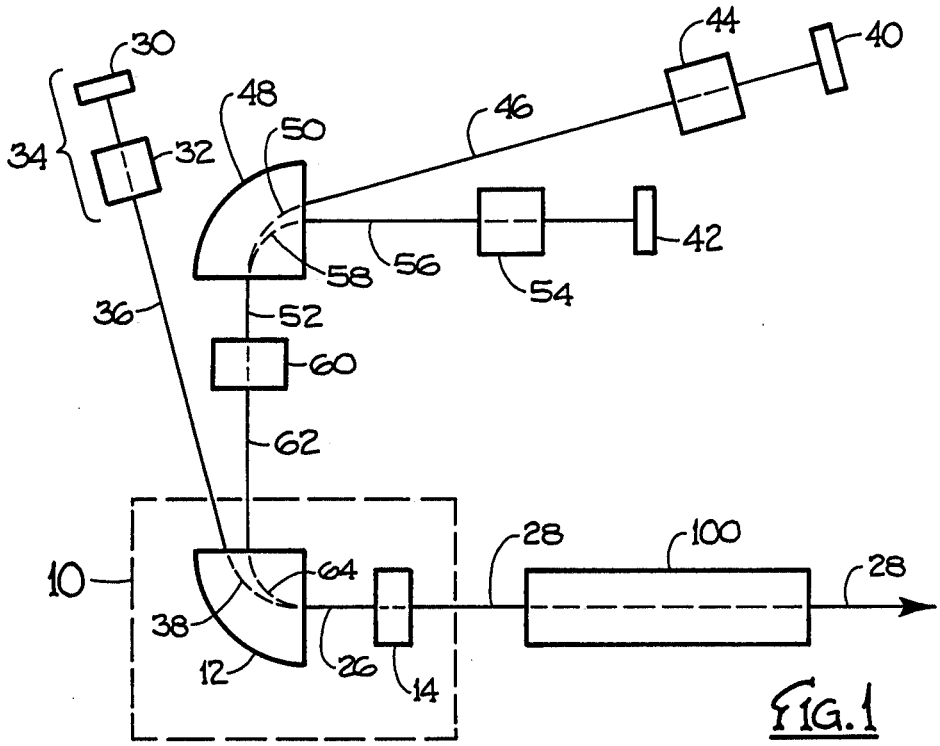
FIG. 1 is a schematic view of the present invention in its intended environment.

Referring initially to FIG. 1, a schematic representation of the funnel of the present invention is seen in its intended environment and is generally designated 10. As shown in FIG. 1, the major components of funnel 10 are a magnetic lens 12 and a resonator 14. More specifically, lens 12 is incorporated into funnel 10 for the purpose of colinearly aligning ions having different energy levels and resonator 14 is incorporated for the purpose of equalizing those energy levels by respectively accelerating or decelerating ions having relatively lower or higher energy levels.

It will be helpful if it is appreciated that lens 12 is essentially a mass spectrometer which is operated in reverse. In other words, whereas a mass spectrometer operates by subjecting a beam of ionized particles to an electric or magnetic field which deflects particles in angles proportional to their mass or energy levels, lens 12 receives ions from angles according to their energy level and deflects them onto a common beam. The geometry of this operation will be best appreciated by reference to FIG. 2.

Figure 2:
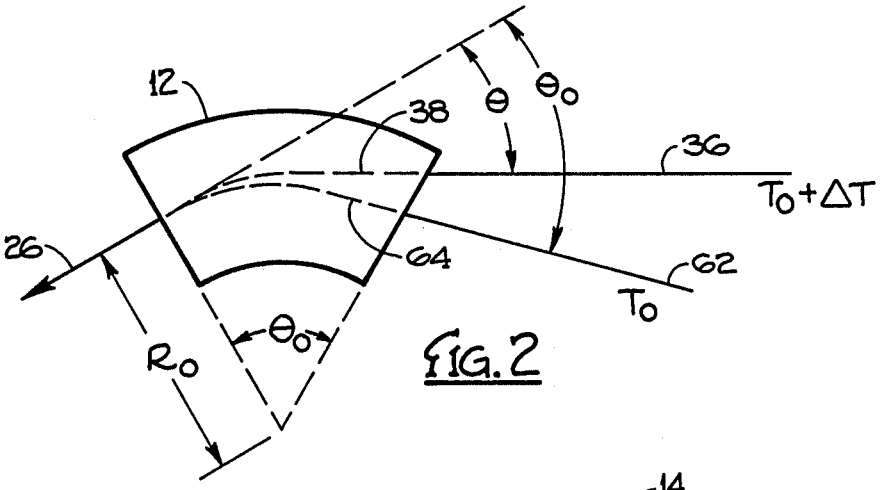
FIG. 2 is a geometrical representation of the deflected paths of differently energized ions when influenced by a magnetic field.

FIG. 2 shows the geometry of deflection for ions of mass m, having a charge q and an energy level of $T_o$ or $T_o+\Delta T$ as they pass through a lens 12 having a uniform magnetic field B. For these conditions, the particle having an energy level of $T_o$ will be deflected through an angle $\theta_o$ with a radius of deflection which can be expressed as:

$$R_o = \frac{\sqrt{2mT_o}}{qB}$$

Further understanding of the present invention is gained by considering two ions of different energy levels and the effect lens 12 will have on their paths. For this discussion one ion is considered having kinetic energy $T_o$ and the other is considered having kinetic energy $T_o+\Delta T$ ($\Delta T$ is very much smaller than $T_o$). The higher energy particle, i.e. $T_o+\Delta T$, will be deflected during its transit of lens 12 on a path with a radius of deflection R (which is greater than $R_o$) through an angle $\theta$ (which is smaller than $\theta_o$). The relationship of these variables is:

$$\theta \simeq \theta_o - \frac{\Delta T}{2T_o}\sin\theta_o$$

Reference to FIG. 2 shows that the direction from which each ion beam should be directed at lens 12 will depend on their respective energy levels. Thus, the difference in energy, $\Delta T$, is not only important in determining the directions from which the ions approach lens 12, it also must be considered in determining the range of energies and their acceptability for the next stage in the accelerator. Theoretically, the allowable difference in energy is approximately:

$$\Delta T \simeq \sqrt{\frac{2m_o v_s^3 q E_o}{\omega}}$$

where $m_o$ is the rest mass, $v_s$, is the synchronous velocity, q is the charge, $E_o$ is the peak electric field, and $\omega$ is the rf frequency.

Figure 3:
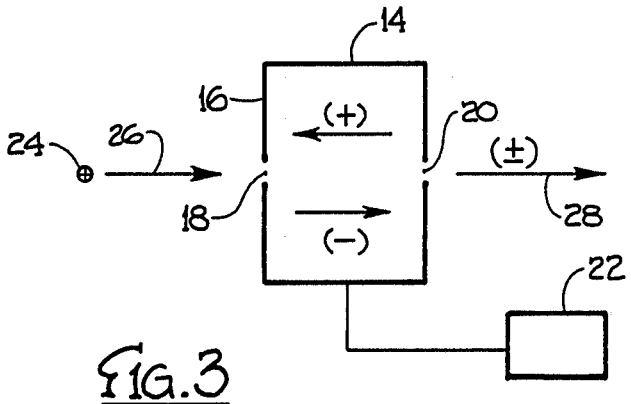
FIG. 3 is a schematic view of a resonator as incorporated into the present invention.

From the above it will be appreciated that a proper orientation of ion beams aimed at lens 12 will allow ions of different energy levels to be colinearly aligned. The equalization of energy levels for ions in this combined beam is accomplished by a resonator 14 which is shown schematically in FIG. 3. Essentially, resonator 14 comprises a hollow enclosure 16 which is made of conducting materials well known in the pertinent art. As is also well known in the pertinent art, enclosure 16 is properly dimensioned to reinforce electromagnetic radiation of a desired frequency. Resonator 14 is formed with an entry aperture 18 and an exit aperture 20. An rf generator 22 is operatively coupled to enclosure 16 to establish a resonance within resonator 14. As envisioned by the present invention, a charged particle, i.e. ion 24, will proceed on path 26 and enter aperture 18 of resonator 14. Once within enclosure 16, ion 24 is either accelerated or decelerated depending on the phase of the resonating frequency in the enclosure 16. As is well known in the art, this acceleration or deceleration respectively either raises or lowers the kinetic energy level of the ion 24. Ion 24 then exits enclosure 16 through aperture 20 and proceeds along path 28. With proper input to resonator 14, each ion 24 has had its energy level properly altered by resonator 14 so that each ion 24 which exits resonator 14 and travels along path 28 has substantially the same energy level as every other ion 24 or path 28.

Referring back to FIG. 1, it will be seen that input to funnel 10 is provided by an apparatus, such as origin 34, which comprises an ion source 30 and a low frequency accelerator 32. Essentially, ion source 30 can be any device which will create electrically charged particles. Typically, as is well known in the pertinent art, this is done by sending an electric discharge through a gas. The low frequency accelerator 32 can also be a device well known in the art, such as an rf quadrupole. In accordance with the present invention, source 30 provides charged ions at approximately the 50 KeV energy level which are accelerated by accelerator 32 to the 2 MeV energy level and then aimed along path 36 toward funnel 10. In FIG. 2, ion 24 traveling along path 36 is represented as having an energy level $T_o+\Delta T$. The influence of lens 12 on this ion is to deflect it along the curvilinear path 38 until it emerges from lens 12 to continue its travel on path 26. The subsequent action on ion 24 by resonator 14 is as discussed above in conjunction with the schematic representation of FIG. 3.

As stated above, it is intended that ions having different energy levels be presented to funnel 10. Thus, a second source, similar to origin 34, can be provided or various sources can be cascaded. FIG. 1 shows a system wherein additional ion sources are cascaded. Specifically, FIG. 1 shows how ion sources 40 and 42 can be combined as input to funnel 10. To do this, ions 24 from sources 40 and 42 are respectively accelerated to different energy levels by low energy accelerators 44 and 54 and aimed at lens 48 along paths 46 and 56. Lens 48, in a manner as previously discussed for lens 12, deflects ions from path 46 and 56 along the curvilinear paths 50 and 58. As shown in FIG. 1, the colinearly aligned ions from ion sources 40 and 42 emerge from lens 48 traveling along the common path 52. Resonator 60 then accelerates or decelerates ions 24 to bring all ions leaving resonator 60 to substantially the same level of energy. The action of resonator 60 is, in all important respects, the same as previously discussed in connection with resonator 14.

In comparison with ions on path 36, it will be understood that ions 24 which leave resonator 60 on path 62 have an energy level equal to $T_o$. Reference to FIG. 2 then shows that these ions are deflected along the curvilinear path 64 by lens 12 and are combined with the ions having energy level $T_o+\Delta T$ which are coming from source 30 along curvilinear path 38. Together the ions on paths 36 and 62 are colinearly aligned by lens 12 and emerge from lens 12 on path 26. Subsequently, resonator 14 equalizes the energy levels of ions 24 and sends them along path 28 toward a linear accelerator 100.

Figure 4:
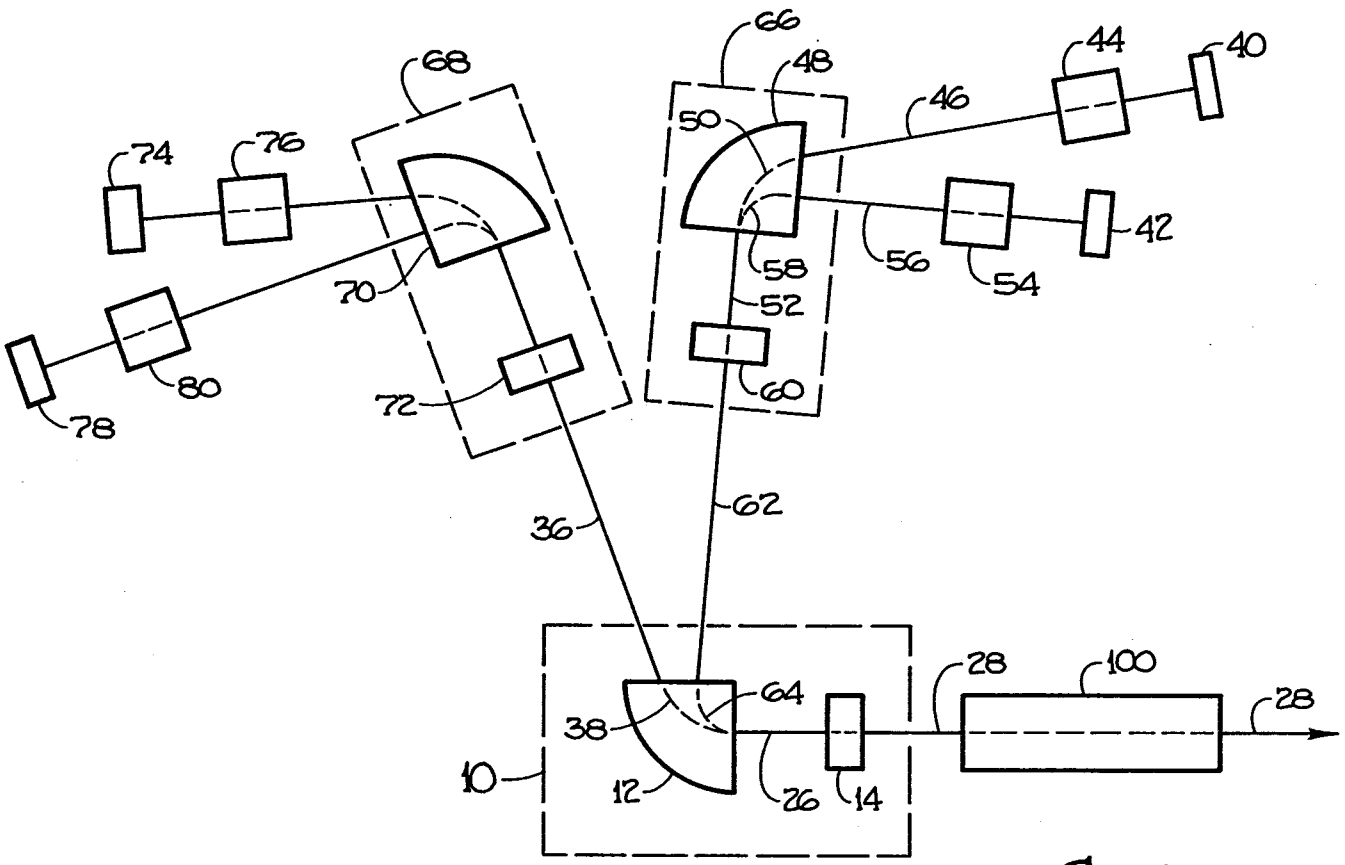
FIG. 4 is a schematic view of cascaded ion sources using funnels in accordance with the present invention.

FIG. 4 shows the basic scheme for cascading pairs of ion sources. In FIG. 4, ion sources 40 and 42, as previously disclosed, are shown using funnel 66 to establish a colinearly aligned beam of ions traveling along path 62 which all have substantially the same energy level. As shown in FIG. 4, funnel 66 comprises lens 48 and resonator 60. FIG. 4 also shows that a funnel 68 comprising a lens 70 and a resonator 72 can be set up to colinearly align ions from sources 74 and 78. In a manner as discussed above, ion sources 74 and 78 provide ions which are respectively accelerated to different energy levels by low energy accelerators 76 and 80 and aimed at lens 70 of funnel 68. Funnel 68 then acts on ions from sources 74 and 78 in a manner as previously discussed for funnel 10 to create the beam of ions traveling on path 36. Ions on paths 36 and 62 are thus established with different energy levels which can be subsequently acted upon by funnel 10 for presentation as input to linear accelerator 100.

The number of ion sources which can be cascaded in the manner just discussed is practically limited only by the frequency at which linear accelerator 100 can accept input. It is to be understood that any linear accelerator well known in the pertinent art can be be used for the purposes of the present invention. Also, it will be understood that the resonator of each funnel, e.g. resonator 14 of funnel 10, will be synchronized to accelerate ions of relatively lower energy and decelerate ions of higher energy to establish an ion beam wherein all ions have substantially the same energy level. This requires that input to the funnel from the ion sources be alternated. For example, in FIG. 4, the funnel 10 will alternatingly accept input from funnels 66 and 68. As shown, the output from funnel 66 will have a lower energy level than the output from funnel 68. Thus, lens 12 sees input with relatively low energy from funnel 66 and then it will see input with relatively high energy from funnel 68. The result is that the ions on path 26 are "bunched" according to their energy levels. Resonator 14 then acts on these "bunched" ions to sequentially accelerate or decelerate them, as required, to provide ions as input for linear accelerator 100 which all have substantially the same energy level.

While the particular ion funnel as herein shown and disclosed in detail is fully capable of obtaining the objects and providing the advantages herein before stated, it is to be understood that it is merely illustrative of the presently preferred embodiment of the invention and that no limitations are intended to the details of construction or design herein shown other than as defined in the appended claims.

I claim:

1. A device for funneling charged particles into an accelerator which comprises:
   means for generating a magnetic field to align particles having different energy levels; and
   means for receiving said aligned particles and accelerating particles of relatively lower energy and decelerating particles of relatively higher energy to produce a beam of particles having substantially the same energy level.

2. A device as recited in claim 1 further comprising:
   a plurality of charged particle sources; and
   a plurality of accelerators, each of said accelerators being respectively associated with at least one of said charged particle sources to energize particles from said respective source to a predetermined energy level and to aim said energized particles toward said magnetic aligning means.

3. A device as recited in claim 2 further comprising means for sequentially activating said accelerators to successively send energized particles from each one of said accelerators to said magnetic aligning means.

4. A device as recited in claim 3 wherein said energized particles from one of said accelerators have said relatively higher level of energy and energized particles from another of said accelerators have said relatively lower level of energy.

5. A device as recited in claim 4 wherein said accelerating and decelerating means is synchronized for operative association with said accelerators.

6. A device as recited in claim 5 wherein said accelerating and decelerating means is a resonator.

7. A device as recited in claim 6 wherein each of said accelerators is a radio frequency quadrupole.

8. A device for combining ions which are emitted from a plurality of ion origins at different energy levels into a beam of ions having substantially the same energy levels which comprises:
   a lens for receiving said ions from said origins and deflecting said ions into alignment; and
   means for receiving said ions to accelerate said ions having the relatively lower energy level and to decelerate said ions having the relatively higher energy level to form said beam.

9. A device as recited in claim 8 wherein said lens is a magnet.

10. A device as recited in claim 9 wherein said accelerating/decelerating means is a resonator.

11. A device as recited in claim 10 wherein each of said ion origins comprises:
   an ion source; and
   an accelerator operatively associated with said ion source to energize ions from said source to a predetermined energy level and send said energized ions to said lens.

12. A device as recited in claim 11 further comprising means to synchronize said ion origins to alternatively send said energized ions toward said lens.

13. A device as recited in claim 12 further comprising means to synchronize said resonator with said origin synchronizing means.

14. A device as recited in claim 13 further comprising a linear accelerator positioned to receive said beam for further acceleration of said ions.

15. A method for aligning ions from different ion sources into a beam of ions having substantially the same energy level which comprises the steps of:

(a) establishing a plurality of said ion sources;

(b) energizing ions from each of said sources to a predetermined energy level which is different from the energy level of ions from any other of said sources;

(c) aiming said energized ions at a lens;

(d) deflecting said differently energized ions into alignment on a common path;

(e) accelerating said relatively lower energized ions to an intended energy level; and (f) decelerating said relatively higher energized ions to said intended energy level.

16. A method as recited in claim 15 further comprising the step of synchronizing said aiming step with said accelerating and said decelerating steps.

17. A method as recited in claim 16 further comprising the step of accelerating said aligned ions from said intended energy level to a higher level.

* * * * *